US006079645A

United States Patent [19]

Henreckson et al.

[11] Patent Number: 6,079,645

[45] Date of Patent: Jun. 27, 2000

[54] DESKTOP SHREDDERS

[75] Inventors: Todd Henreckson, Antioch; Carolyn Mueller, Mt. Prospect; Jean Rabisse, Deerfield; Toheed I. Bhatti, Tinley Park; Greg Carrillo, Chicago; Nicholas M. Nanos, Morton Grove, all of Ill.

[73] Assignee: General Binding Corporation, Skokie, Ill.

[21] Appl. No.: 09/153,671

[22] Filed: Sep. 15, 1998

[51] Int. Cl.[7] ..... B02C 18/16

[52] U.S. Cl. ..... 241/37.5; 29/428; 241/100; 241/236

[58] Field of Search ..... 241/36, 100, 236, 241/37.5; 29/428

[56] References Cited

U.S. PATENT DOCUMENTS

| | | | |
|---|---|---|---|
| D. 375,973 | 11/1996 | Kennedy et al. . | |
| 2,101,700 | 12/1937 | Chestnut, Jr. . | |
| 3,620,461 | 11/1971 | Pelleschi et al. | 241/100 |
| 3,724,766 | 4/1973 | Bosland . | |
| 4,257,565 | 3/1981 | Hatanaka | 241/100 |
| 4,489,897 | 12/1984 | Turner et al. . | |
| 4,637,560 | 1/1987 | Goldhammer . | |
| 4,657,193 | 4/1987 | Whittenburg et al. | 241/285.1 |
| 4,973,004 | 11/1990 | Krause et al. . | |
| 5,035,366 | 7/1991 | Hashimoto et al. | 241/100 |
| 5,375,781 | 12/1994 | Schwelling | 241/100 |

OTHER PUBLICATIONS

OKANO paper shredder, Model No. AGS1018C, 3 pages of digital photographs, known prior to Sep. 15, 1998.

*Primary Examiner*—Mark Rosenbaum
*Attorney, Agent, or Firm*—Hill & Simpson

[57] ABSTRACT

The present invention provides new paper shredding devices mountable on various horizontal and vertical surfaces. The paper shredder has a housing defining a paper inlet and a shredding knife in the housing positioned downstream of the paper inlet. A shredding knife controller is connected to the shredding knife. A shredded paper receptacle is positioned downstream of the shredding knife. A bottom of the housing serves as a tabletop mount for standing the shredder on a tabletop. One or more holes may be provided in the back side of the housing to permit the shredder to be mounted on a wall.

22 Claims, 4 Drawing Sheets

FIG. 1
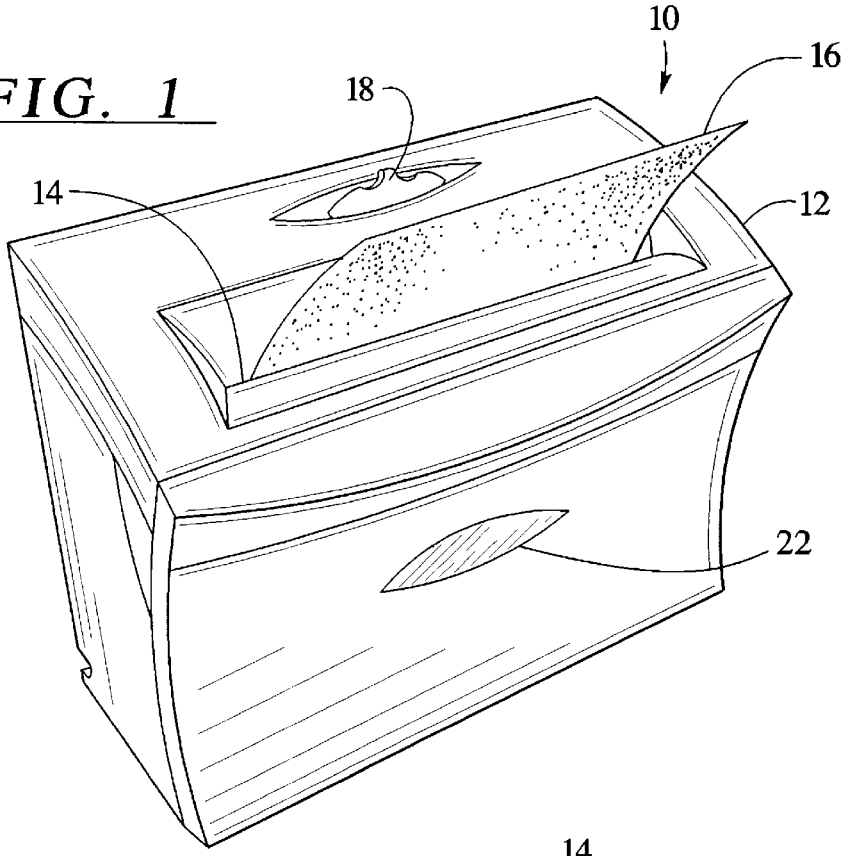
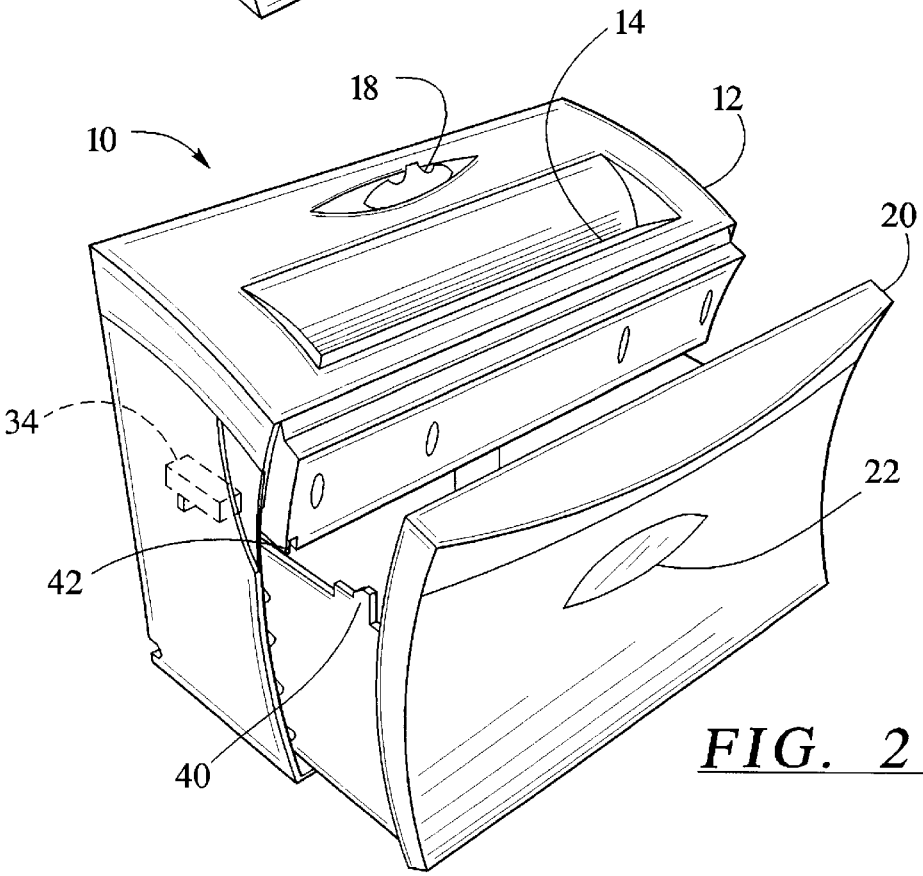
FIG. 2

DESKTOP SHREDDERS

FIELD OF THE INVENTION

The present invention generally relates to document shredding devices and more specifically, the present invention relates to new desktop shredders which can be mounted on various locations.

BACKGROUND OF THE INVENTION

Existing paper shredding devices have been mounted on a side of a separate bin or waste receptacle, such that the paper shredding devices hang on the side over a waste collection area inside the waste receptacle. Shredded pieces shredding knife controller connected to the shredding knife, providing a shredded paper receptacle downstream of the shredding knife, providing a tabletop mount connected to the housing, and providing a wall mount connected to the housing.

One new method of using paper shredders having a tabletop mount and a wall mount according to the present invention includes selecting a mounting location of either a tabletop location or a wall location, mounting the paper shredder at the mounting location by one of either placing the paper shredder on the tabletop location if the tabletop location is selected or hanging the paper shredder on the wall location if the wall location is selected, actuating a shredding knife, and feeding paper to be shred into the paper shredder.

One advantage of the present invention is to provide new paper shredders.

Another advantage of the present invention is to provide new paper shredders which can be mounted on a desktop and also mounted on a wall.

Another advantage of the present invention is to provide convenient and cost effective ways of making and using paper shredders. The new paper shredding devices can be mounted and used on a variety of types of tabletops and walls.

These and other objects and advantages of the present invention will become apparent upon reading this disclosure, including the appended claims of paper exiting the paper shredding devices fall into the separate waste receptacle for collection. These paper shredding devices cannot stand alone upright on a desktop. Also, these paper shredders do not have wall mounts which permit the shredders to be mounted to a wall, for example a wall of an office or home. These paper shredders may not have waste receptacles built into the shredders. Some small personal shredders are even sold without shredder baskets and must rely on waste paper baskets normally found in the office or in the home.

Relatively large paper shredders which stand on the floor are also available. These large paper shredders are designed for shredding large amounts of paper and may be cost prohibitive for shedding smaller amounts of paper.

Existing paper shredders are described in U.S. Pat. No. 3,724,766; 4,637,560; 4,973,004; D375,973; and pending application Ser. No. 08/720,579 filed Oct. 2, 1996; 09/080,471 filed May 18, 1998; and 29/087,673 filed May 7, 1998.

Mechanisms for shredding documents, such as sheets of paper, fed into shredders can be derived from the above cited utility patents, and also from U.S. Pat. No. 4,489,897.

In view of the existing paper shredders, it would be an advantage to have a new desktop shredder which can be mounted on various locations, for example on a horizontal surface and on a vertical wall. with reference to the accompanying drawings. Although these and other objects and advantages may be desired, they may not be required to practice the present invention.

BRIEF DESCRIPTION OF THE DRAWINGS

FIG. 1 is a perspective view of a desktop shredder according to the principles of the present invention.

FIG. 2 is another perspective view of the desktop shredder of FIG. 1, showing a shredded paper basket opened.

SUMMARY OF THE INVENTION

Figure 3:
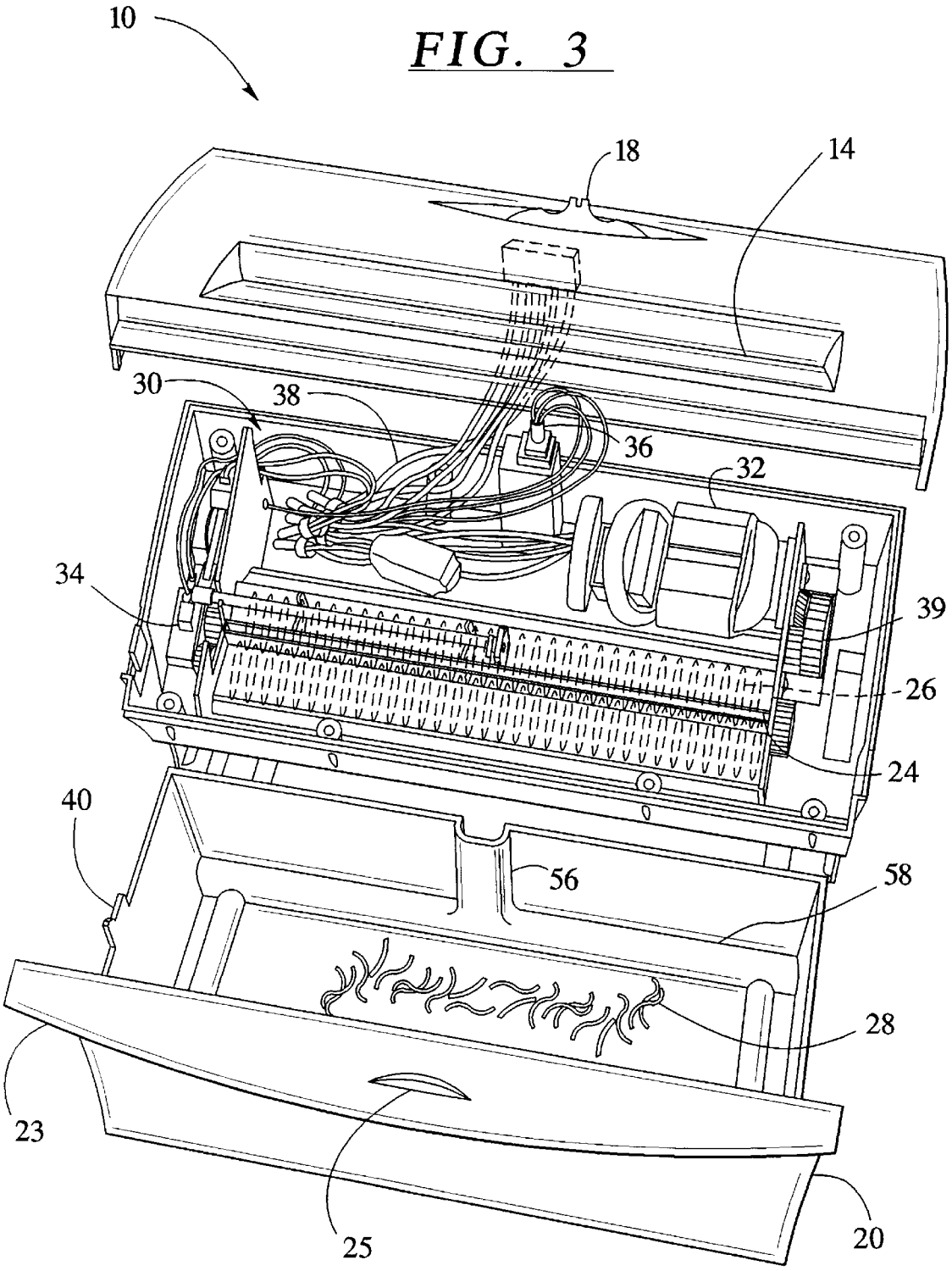
FIG. 3 is a partially exploded, perspective view of the desktop shredder of FIG. 1.

The present invention provides new document shredding devices for shredding paper documents. The new document shredding devices can be mounted on horizontal surfaces, such as desktops and tabletops, and also mounted on vertical surfaces, such as office walls or walls in a home. Although the present invention is referred to as desktop shredders, the invention can be used on a wide variety of generally horizontal and vertical surfaces.

One desktop shredder according to the present invention has a housing defining a paper inlet and a shredding knife in the housing positioned downstream of the paper inlet. A shredding knife controller is connected to the shredding knife. A shredded paper receptacle is positioned downstream of the shredding knife. The housing has a tabletop mount for mounting the shredder to a tabletop and a wall mount for mounting the shredder to a wall. The bottom of the housing may be the tabletop mount such that the shredder can be placed standing upright on the top of the table. One or more holes may be provided in the back side of the housing to permit the shredder to be mounted on a wall.

The present invention also provides new methods of making and using paper shredders. One new method of making paper shredders according to the present invention includes providing a housing defining a paper inlet, providing a shredding knife in the housing and downstream of the paper inlet, providing a

DETAILED DESCRIPTION OF PRESENTLY PREFERRED EMBODIMENTS

Although the present invention can be made in many different forms, the presently preferred embodiments are described in this disclosure and shown in the attached drawings. This disclosure exemplifies the principles of the present invention and does not limit the broad aspects of the invention only to the illustrated embodiments.

A new desktop shredder 10 according to the principles of the present invention is shown by way of example in FIG. 1. The desktop shredder 10 can be mounted on a desktop or on a wall as described further below. The desktop shredder 10 has a housing 12 which defines a paper inlet 14 in the top of the housing. One or more sheets of paper 16 to be shredded can be inserted into the paper inlet 14 for shredding the paper 16. A control switch 18 is provided on the top of the housing 12 to turn the desktop shredder on and off. The control switch 18 may also have a reverse position which reverses the shredding mechanism inside the housing 12 to the release paper 16 when the paper 16 is jammed in the shredder.

Referring to FIG. 2, a shredded paper receptacle in the form of a basket 20 is provided to hold shredded paper. The basket 20 is slidable relative to the housing 12 and can be easily removed from the housing 12 to empty the shredded paper from the basket 20. A window 22 may be provided in the basket 20 so that the inside area of the basket 20 can be viewed to assist in determining when to empty the basket 20. The window 22 may be made of a transparent plastic, for example. Referring to FIG. 3, a handle 23 is provided on the basket 20 for grasping, opening and closing the basket 20. An indentation 25 may be provided in the handle 23 to assist in grasping the handle 23.

The desktop shredder 10 is shown in FIG. 3 with the top of the housing 12 removed and the shredded paper basket 20 slid out from the housing 12. A paper pathway 24 is aligned with the paper inlet 14 in the housing 12 and aligned with a shredding knife mechanism 26. Accordingly, the shredding knife mechanism 26 is downstream of the paper inlet 14. The shredding knife mechanism 26 is a cross-cut shredding knife mechanism which cuts the paper 16 in multiple directions. The cross-cut knife cuts the paper 16 into short strips of shredded paper 28 by cutting the paper 16 lengthwise in the same direction as the direction the paper 16 is fed into the desktop shredder 10 and also cuts the paper 16 perpendicular to the lengthwise cutting direction. The short strips of shredded paper 28 fall into the basket 20 which is downstream of the shredding knife mechanism 26. The short strips of shredded paper 28 generally use less space than longer shredded strips of paper, and thus more paper 16 can be shredded and placed in the basket 20 by using the cross-cut shredding knife mechanism 26. Also, cross-cut shredded paper provides a higher degree of security as compared to straight cut strips of paper.

A shredding knife controller 30 is provided to control the operation of the desktop shredder 10. The shredding knife controller 30 includes associated electrical components which drive the shredding knife mechanism 26. The shredding knife controller 30 may include the control switch 18, a motor 32, a safety switch 34, an electrical power cord 36 (see also FIG. 5), and wires 38 electrically connecting these components together. The motor 32 drives a gear mechanism 39 which drives the shredding knife mechanism 26.

Because the shredding knife mechanism 26 shreds the paper 16 in a cross-cut manner, the shredding knife mechanism 26 requires additional power as compared to a straight cut shredding knife. Accordingly, the motor 32 may run from standard 110 volt ac current rather than at a low voltage current produced by a transformer.

Referring to FIGS. 2 and 3, the safety switch 34 is a cut-off switch which automatically turns the shredding knife mechanism 26 off when the basket 20 is slid outward. When the basket 20 is slid inward to a shredded paper receiving position as shown in FIG. 1, the safety switch 34 enables the shredding knife mechanism 26 to be operated to shred paper. A switch arm 40 extends from the basket 20 to engage and actuate the safety switch 34. A switch arm channel 42 (FIG. 2) may be provided in the housing 12 to guide the switch arm 40 to the safety switch 34.

Figure 4:
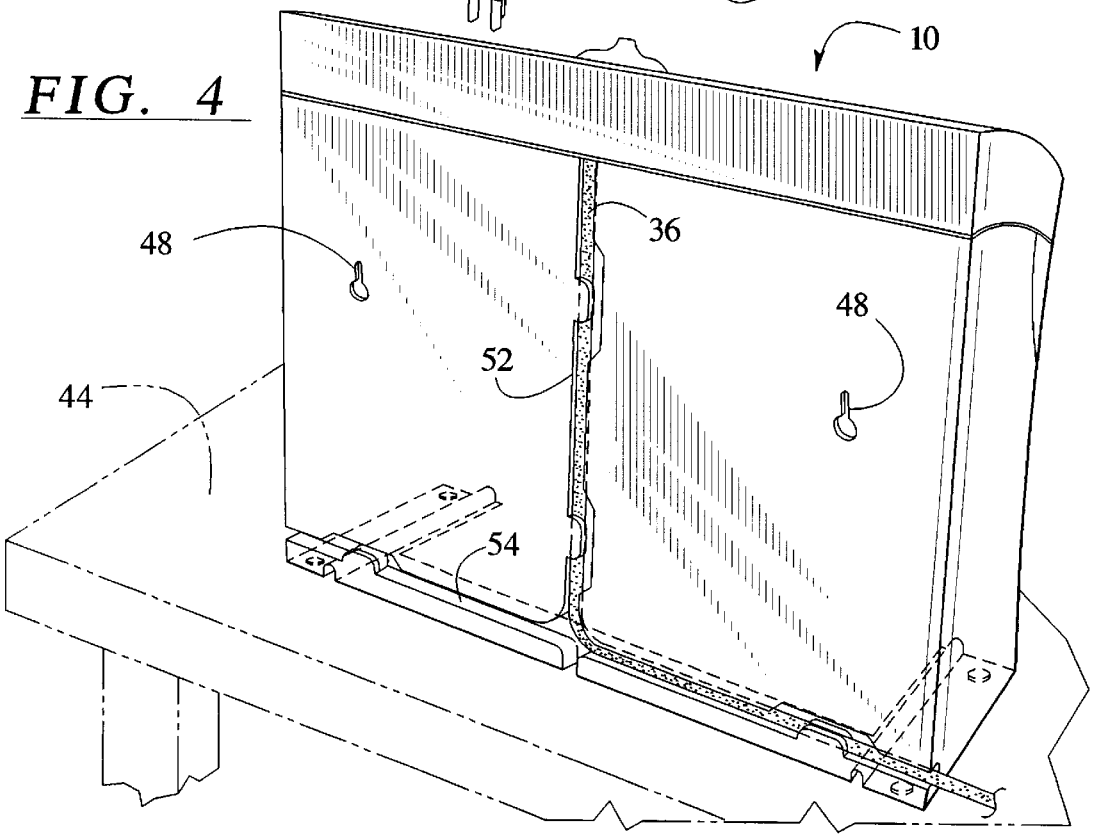
FIG. 4 is a rear perspective view of the desktop shredder of FIG. 1 showing the desktop shredder mounted on a tabletop.

The desktop shredder 10 is shown mounted on a desktop 44 in FIG. 4. The bottom of the housing 12 defines a tabletop mounting such that the desktop shredder can stand upright when placed on the desktop 44. The bottom of the housing 12 is shown as resting on the desktop 44. However, if desired, the housing 12 could be modified to fasten the desktop shredder 10 to the desktop 44.

Figure 5:
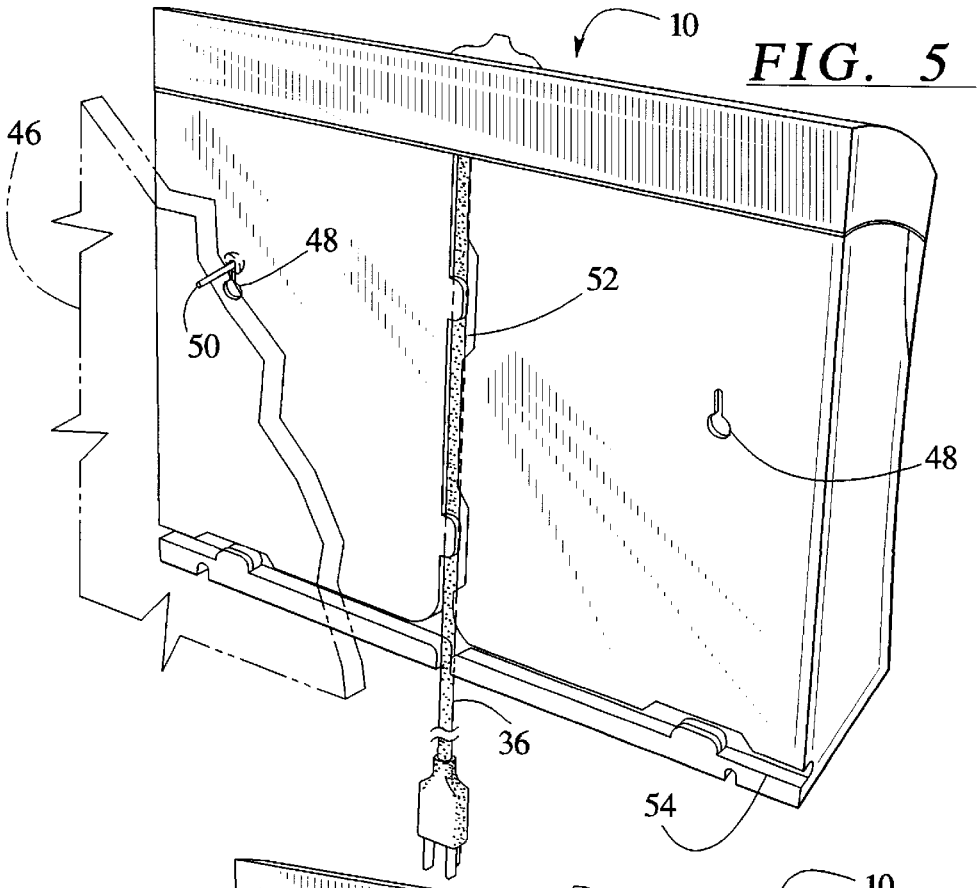
FIG. 5 is another rear perspective view of the desktop shredder of FIG. 1 showing the desktop shredder mounted on a wall.

The desktop shredder 10 is shown mounted on a wall 46 in FIG. 5. One or more mounting holes 48 are defined in the back side of the housing 12. The desktop shredder 10 can be mounted on the wall 46 by anchoring a fastener 50 in the wall 46 and hanging the desktop shredder 10 on the fastener 50 with the fastener 50 extending into the mounting hole 48. Although the wall mounts are shown as mounting holes 48 defined in the back of the housing 12, the invention contemplates the use of other mounting structures to mount the desktop shredder on the wall 46. Accordingly, the desktop shredder 10 can be used by selecting either a desktop location or a wall location and then mounting the desktop shredder 10 to the selected location.

Cord channels may be provided on the back side of the housing 12 which can contain the electrical power cord 36. For example, a substantially vertical cord channel 52 may extend from the top of the housing downward and a substantially horizontal cord channel 54 may extend from the cord channel 52 to and outside edge of the housing 12. The cord channels 52, 54 can be used to conceal the power cord 36 and also to permit the desktop shredder 10 to be placed flush against a wall, either in the wall mount position or the desktop mount position. Referring to FIG. 3, a back wall of the basket 20 may have recesses 56, 58 which receive the cord channels 52, 54, respectively, when the basket 20 is slid inward to its shredded paper receiving position.

Figure 6:
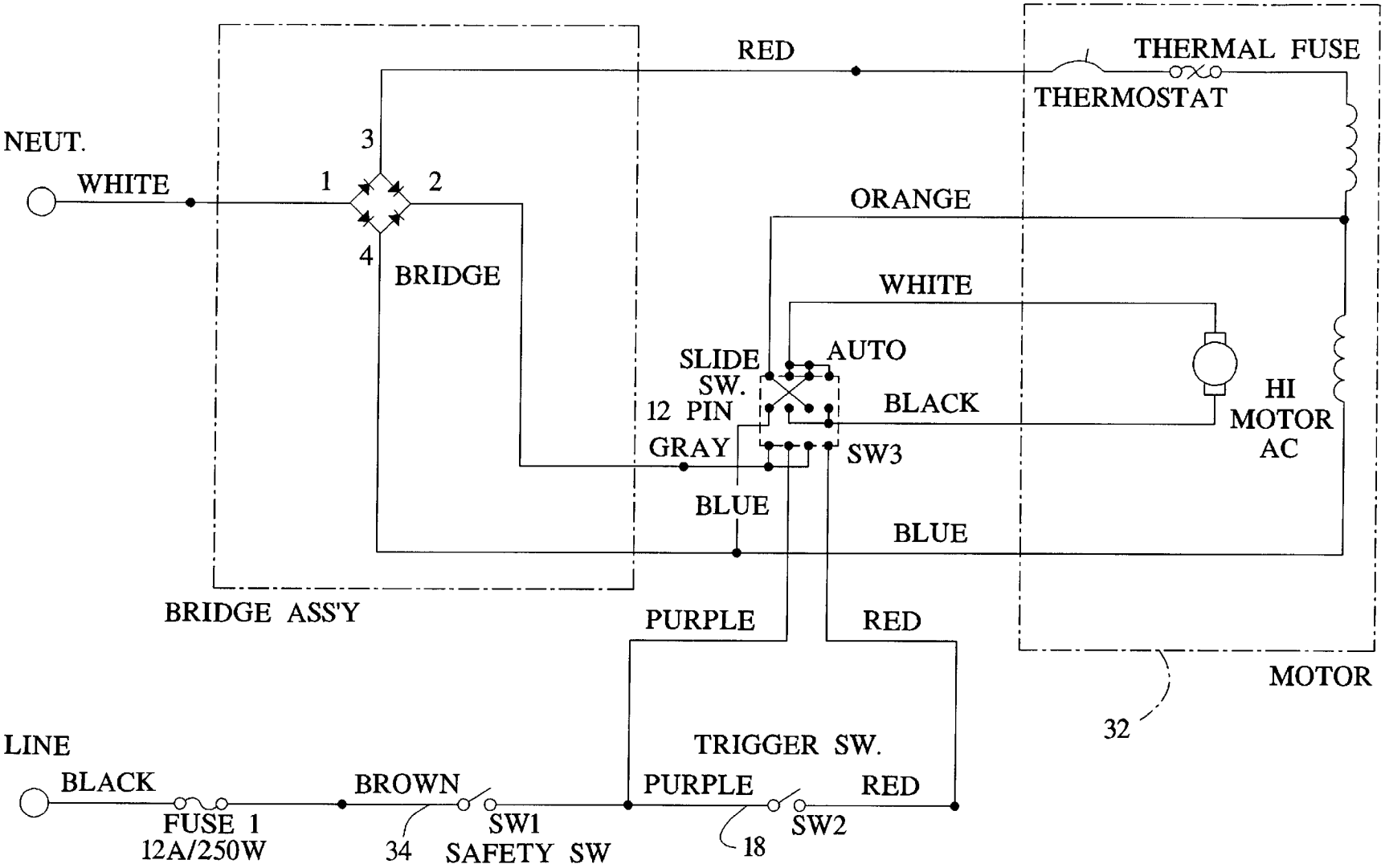
FIG. 6 is a schematic diagram of the electrical components for the desktop shredder of FIG. 1.

Referring to FIG. 6, a schematic diagram of the electrical components for the desktop shredder is shown.

While the presently preferred embodiments have been illustrated and described, numerous changes and modifications can be made without significantly departing from the spirit and scope of this invention. Therefore, the inventors intend that such changes and modification are covered by the appended claims.

We claim as our invention:

1. A paper shredder comprising:

a housing defining a paper inlet;

a shredding knife in the housing and downstream of the paper inlet;

a shredding knife controller connected to the shredding knife;

a shredded paper receptacle downstream of the shredding knife;

a tabletop mount connected to the housing; and a wall mount connected to the housing and capable of supporting the paper shredder during shredding of paper.

2. The paper shredder of claim 1 wherein the housing has a bottom which defines the tabletop mount.

3. The paper shredder of claim 1 wherein the wall mount comprises at least one opening defined in a back wall of the housing.

4. The paper shredder of claim 3, wherein the at least one opening is open to an interior of the housing.

5. The paper shredder of claim 1 wherein the housing has a back wall and a cord channel is defined recessed inward from an outside surface of the back wall of the housing.

6. The paper shredder of claim 5 wherein the back wall of the housing defines a substantially vertical cord channel extending downward from a top section of the housing and a substantially horizontal cord channel extending from the substantially vertical cord channel to an outside edge of the housing.

7. The paper shredder of claim 5 wherein the shredded paper receptacle has a wall defining a recess which receives the cord channel in the back wall of the housing.

8. The paper shredder of claim 1 wherein the shredding knife is a crosscut shredding knife.

9. The paper shredder of claim 1 wherein the shredded paper receptacle comprises a basket removably mounted to the housing.

10. The paper shredder of claim 9 wherein the shredded paper receptacle has a window wherein an inside area of the shredded paper receptacle can be viewed from outside the paper shredder.

11. The paper shredder of claim 1 wherein the shredding knife controller has a cut-off switch automatically placed in an ON position when the shredded paper receptacle is in a shredded paper receiving position and automatically placed in an OFF position when the shredded paper receptacle is not in the shredded paper receiving position.

12. The paper shredder of claim 11 wherein the shredded paper receptacle has a switch arm extending from the shredded paper receptacle and having positions engaged with and disengaged from the cut-off switch.

13. A paper shredder comprising:

a housing defining a paper inlet;

a shredding knife in the housing and downstream of the paper inlet;

a shredding knife controller connected to the shredding knife;

a shredded paper basket removably mounted to the housing and downstream of the shredding knife;

a tabletop mount defined by a bottom of the housing; and a wall mount connected to the housing and capable of supporting the paper shredder during shredding of paper.

14. The paper shredder of claim 13 wherein:

the shredded paper basket has a switch arm extending from the shredded paper basket; and the shredding knife controller has a cut-off switch automatically placed in an ON position when the switch arm of the shredded paper basket is engaged with the cut-off switch, and automatically placed in an OFF position when the switch arm of the shredded paper basket is disengaged with the cut-off switch.

15. The paper shredder of claim 14 wherein the housing has a back wall and a cord channel is defined recessed inward from an outside surface of the back wall of the housing.

16. The paper shredder of claim 15 wherein the housing has a bottom which defines the tabletop mount.

17. The paper shredder of claim 16 wherein the shredding knife is a crosscut shredding knife.

18. The paper shredder of claim 13, wherein the wall mount comprises at least one opening which is open to an interior of the housing.

19. A method of making a paper shredder comprising the steps of:

providing a housing defining a paper inlet;

providing a shredding knife in the housing and downstream of the paper inlet;

providing a shredding knife controller connected to the shredding knife;

providing a shredded paper receptacle downstream of the shredding knife;

providing a tabletop mount connected to the housing; and providing a wall mount connected to the housing and capable of supporting the paper shredder during shredding of paper.

20. The method of claim 19, further comprising the step of providing the shredding knife controller with a cut-off switch that is automatically placed in an ON position when the shredded paper receptacle is in a shredded paper receiving position and automatically placed in an OFF position when the shredded paper receptacle is not in the shredded paper receiving position.

21. A method of using a paper shredder having a tabletop mount and a wall mount comprising the steps of:

selecting a mounting location of either a tabletop location or a wall location;

selecting one of the tabletop mount and the wall mount of the paper shredder to define a selected shredder mount, both the tabletop and wall mounts being capable of supporting the paper shredder during shredding of paper;

mounting the paper shredder at the mounting location by the selected shredder mount;

actuating a shredding knife; and feeding paper to be shred into the paper shredder.

22. The method of claim 21 further comprising the steps of:

automatically disabling the paper shredder by removing a shredded paper receptacle; and automatically enabling the paper shredder by replacing the shredded paper receptacle.

* * * * *